United States Patent [19]

Hicks et al.

[11] 4,438,369

[45] Mar. 20, 1984

[54] UNITARY LIGHT SOURCE COMPRISING COMPACT HID LAMP AND INCANDESCENT BALLAST FILAMENT

[75] Inventors: John M. Hicks, Penn Hills Township, Allegheny County; Joseph C. Engel, Monroeville, both of Pa.

[73] Assignee: North American Philips Electric Corp., New York, N.Y.

[21] Appl. No.: 513,259

[22] Filed: Jul. 14, 1983

Related U.S. Application Data

[63] Continuation of Ser. No. 282,335, Jul. 10, 1981, abandoned.

[51] Int. Cl.[3] ..... H01J 7/44

[52] U.S. Cl. ..... 315/49; 315/90; 315/92; 315/179; 315/209 R; 315/220

[58] Field of Search ..... 315/49, 90, 92, 179, 315/209 R, 220

[56] References Cited

U.S. PATENT DOCUMENTS

| | | | |
|---|---|---|---|
| 3,749,968 | 7/1973 | Jones et al. | 315/95 |
| 4,151,445 | 4/1979 | Davenport | 315/92 |
| 4,161,672 | 7/1979 | Cap et al. | 313/220 |
| 4,170,744 | 10/1979 | Hanslen | 315/90 |
| 4,170,746 | 10/1979 | Davenport | 315/209 R |
| 4,297,616 | 10/1981 | Corono | 315/179 |
| 4,316,124 | 2/1982 | Verwimp et al. | 315/179 |
| 4,320,325 | 3/1982 | Anderson | 315/DIG. 5 |

OTHER PUBLICATIONS

Tecor Electronic Technical Data T-1105, Jul. 1980, "Sidac Characteristic Curves".

"GE Says it has a Better Light Bulb" by N. R. Kleinfied, Business Week, Jun. 25, 1979, pp. 34–36.

*Primary Examiner*—Harold Dixon

[57] ABSTRACT

Unitary light source comprises compact HID lamp and starting and operating circuit therefor operable from household AC energizing potential. The HID lamp is ballasted by incandescent filament means which also provides the major portion of developed light during HID warm up and after power interruption. The ballast filament and input terminals of a full-wave rectifier connect in series across the light source input terminals and the HID lamp connects across the rectifier output. A low-impedance path means and high-voltage pulse generator, which includes a high-voltage electrode operatively associated with the HID lamp, connect across the rectifier input. Initially, the voltage developed across the rectifier input is relatively high and the pulse generator and low-impedance path means are responsive thereto to devleop high voltage pulses and also provide a low impedance path in series with the ballast filament to cause it to incandesce brightly. The developed high voltage pulses applied to the high voltage electrode ionize the atmosphere within the HID envelope. After the HID lamp starts, the voltage develped across the rectifier input is insufficient to energize the low-impedance path means and pulse generating means. As the HID lamp warms up, the brightness of the incandescent ballast filament means decreases. A lamp keep-alive comprising a DC source is connected across the rectifier means output terminals to provide lamp operating energy during periods of rectifier conduction minima and, if necessary, to provide DC energy as a lamp starting aid.

4 Claims, 3 Drawing Figures

UNITARY LIGHT SOURCE COMPRISING COMPACT HID LAMP AND INCANDESCENT BALLAST FILAMENT

This is a continuation, of application Ser. No. 282,335, filed July 10, 1981 abandoned.

BACKGROUND OF THE INVENTION

This invention relates to compact light sources and, more particularly, to a unitary light source comprising a compact HID lamp and incandescent ballast filament which are adapted to be operated from a household-type source of AC energizing potential.

HID lamps normally require a short period in which to warm up and build up pressure within the lamp, during which time the light output therefrom is limited. Also, after short periods of power interruption, the HID lamp normally cannot be reignited until the pressure therein has dropped. A system for supplying light during warm up and after power interruption is set forth in U.S. Pat. No. 3,749,968 dated July 31, 1973 to Jones et al. wherein a supplemental filament and HID lamp are enclosed within the same outer envelope. When the HID lamp is warming up, or is not operating such as after a period of power interruption, the incandescent filament is operated with full intensity to provide light. After the HID lamp is operating normally, the potential developed across the filament is substantially reduced.

Miniature-type HID metal halide lamps can operate with a high efficacy, as disclosed in U.S. Pat. No. 4,161,672 dated July 17, 1979 to Cap et al. and U.S. Pat. No. 4,170,746 dated Oct. 9, 1979 to Davenport. Various circuits and arrangements for operating such lamps in conjunction with a light-emitting filament which can also serve as a ballast or current limiting impedance for the HID lamp are disclosed in U.S. Pat. No. 4,170,744 dated Oct. 9, 1979 to Hansler and U.S. Pat. No. 4,151,445 dated Apr. 24, 1979 to Davenport et al. Such lamps are also summarized in *New York Times* article June 15, 1979 page D3 and *Business Week,* June 25, 1979, pages 35 and 36.

SUMMARY OF THE INVENTION

There is provided a unitary light source comprising an HID lamp and the light-emitting starting and operating circuit therefor. The light source provides illumination during the warm-up period required for the HID lamp and also after short periods of power interruption when the HID lamp is hot and thus difficult to start. The light source has input terminals which are adapted to be connected to a household-type source of AC energizing potential. The HID lamp comprises an arc-enclosing envelope having spaced electrodes sealed therethrough and operable to sustain a high-intensity-discharge therebetween. An incandescent filament means provides the ballasting for the HID lamp. A full-wave rectifier means has two input terminals and two output terminals and one end portion of the filament ballast connects to one input terminal of the full-wave rectifier, and the other end portion of the filament and the other input terminal of the full-wave rectifier connect across the light source input terminals, with the HID lamp electrodes connecting across the output terminals of the full-wave rectifier. A low impedance path means and high-voltage pulse-generating means operable from the AC energizing potential connect in parallel with the input terminals of the full-wave rectifier. When the HID lamp is not operating, the low impedance path means is responsive each half cycle of AC energizing potential to a predetermined potential which is developed across the input terminals of the full-wave rectifier in order to be actuated and provide a path of low impedance which parallels the input terminals of the full-wave rectifier. The predetermined potential which actuates the low impedance path means is greater than the maximum potential developed across the input terminals of the full-wave rectifier when the HID lamp is operating. The pulse generating means has an output terminal constituting a high-voltage electrode which is operatively associated with the HID lamp, and actuation of the low impedance path means triggers the operation of the pulse-generating means to generate a high voltage of sufficient magnitude to ionize the atmosphere within the arc-enclosing envelope of the HID lamp. There is also provided an HID lamp keep-alive and starting-aid means which has an input connected in circuit with the light source input terminals and an output connected across the output terminals of the full-wave rectifier. Upon initial energization of the light source, the keep-alive means operates to store DC energy of the same polarity as the output of the full-wave rectifier and of a predetermined charge and magnitude sufficient to maintain a discharge in the HID lamp for a short period during the starting thereof, if required, and also during periods of conduction minima of the full-wave rectifier. The low impedance path means and starting-aid means can be combined into one unit or can be formed as separate units connected in parallel in which case the pulse generator can be actuated just prior to the low impedance path means.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
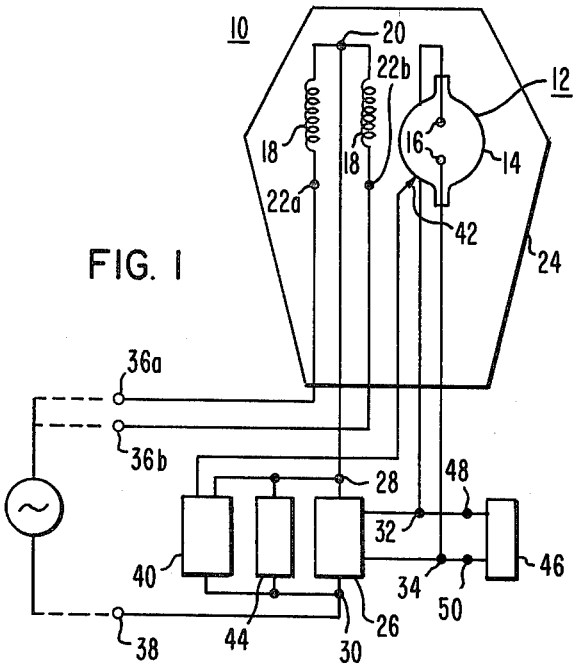
FIG. 1 is a diagrammatic view of an embodiment of the present unitary light source showing the essential elements thereof and the general circuit arrangement therefor.

Referring to FIG. 1, the basic lamp 10 comprises a high efficacy compact HID source 12 comprising an arc-enclosing envelope 14 having spaced electrodes 16 sealed therethrough and operable to sustain a high-intensity-discharge therebetween. There is also provided an incandescent tungsten filament ballast means 18 having two end portions 20 and **22*a*, 22*b*. In this embodiment there are provided two ballasting filaments of differing resistance so that the unitary light source can be operated at two different levels of illumination. The filament means 18 and HID lamp 12 are both enclosed within an outer light-transmitting envelope 24 which preferably is evacuated. A full-wave rectifier means 26 has two input terminals 28 and 30 and two output terminals 32 and 34. One end portion 20 of the filament ballast means 18** connects to one input terminal 28 of the full-wave rectifier means. The other end portion of the filament ballast means (22*a*, 22*b*) and the other input terminal 30 of the full-wave rectifier connect across the unitary light source input terminals 36(*a*), 36(*b*) and 38 which in turn are adapted to be connected to a household-type source of AC energizing potential, 120 V AC 60 Hz.

A high-voltage lamp-starting pulse-generating means 40 is operable from the AC energizing potential and has an output terminal constituting a high-voltage electrode 42 terminating proximate the HID lamp 12. The pulse generating means 40 is responsive to application of the AC energizing potential across the light source input terminals 36(*a*), 36(*b*) and 38 when the HID lamp is not operating to generate high-voltage pulses which are of sufficient magnitude to ionize the atmosphere within the arc-enclosing envelope 14 of the HID lamp 12. After the HID lamp 12 is operating, the pulse-generating means is responsive to a lamp-operating parameter, such as the voltage drop thereacross, to be rendered inoperative.

A low impedance path means 44 connects in parallel with the input terminals 28, 30 of the full-wave rectifier means 26. When the HID lamp is not operating, the low impedance path means 44 is responsive each half cycle of the AC energizing potential to a predetermined potential developed across the input terminals 28, 30 of the full-wave rectifier means 26 to provide a path of low electrical resistance which parallels these input terminals 28, 30. The predetermined potential which actuates the low impedance path means 44 is greater than the maximum potential developed across the input terminals 28, 30 of the full-wave rectifier 26 when the lamp is operating so that once the arc strikes within the lamp 12, the low impedance path means 44 is rendered inoperative. As will be described hereinafter, the pulse generator 40 is actuated in time sequence just prior to the low impedance path means 44 so that once the arc is struck between the lamp electrodes 16, the low impedance path means 44 is thereafter rendered inoperative.

An HID lamp keep-alive means 46 is operable from the AC energizing source and has output terminals 48, 50 which connect across the output terminals 32, 34 of the full-wave rectifier means 26 and the keep-alive means 46 serves to maintain the operation of the HID lamp during periods of conduction minima of the full-wave rectifier means 26. In other devices for operating such a light source, a large electrolytic capacitor is normally connected across the output terminals of the full-wave rectifier in order to supply current during periods of conduction minima of the full-wave rectifier. Because of the current inrushes to the capacitor, the overall power factor of the device is impaired.

Figure 2:
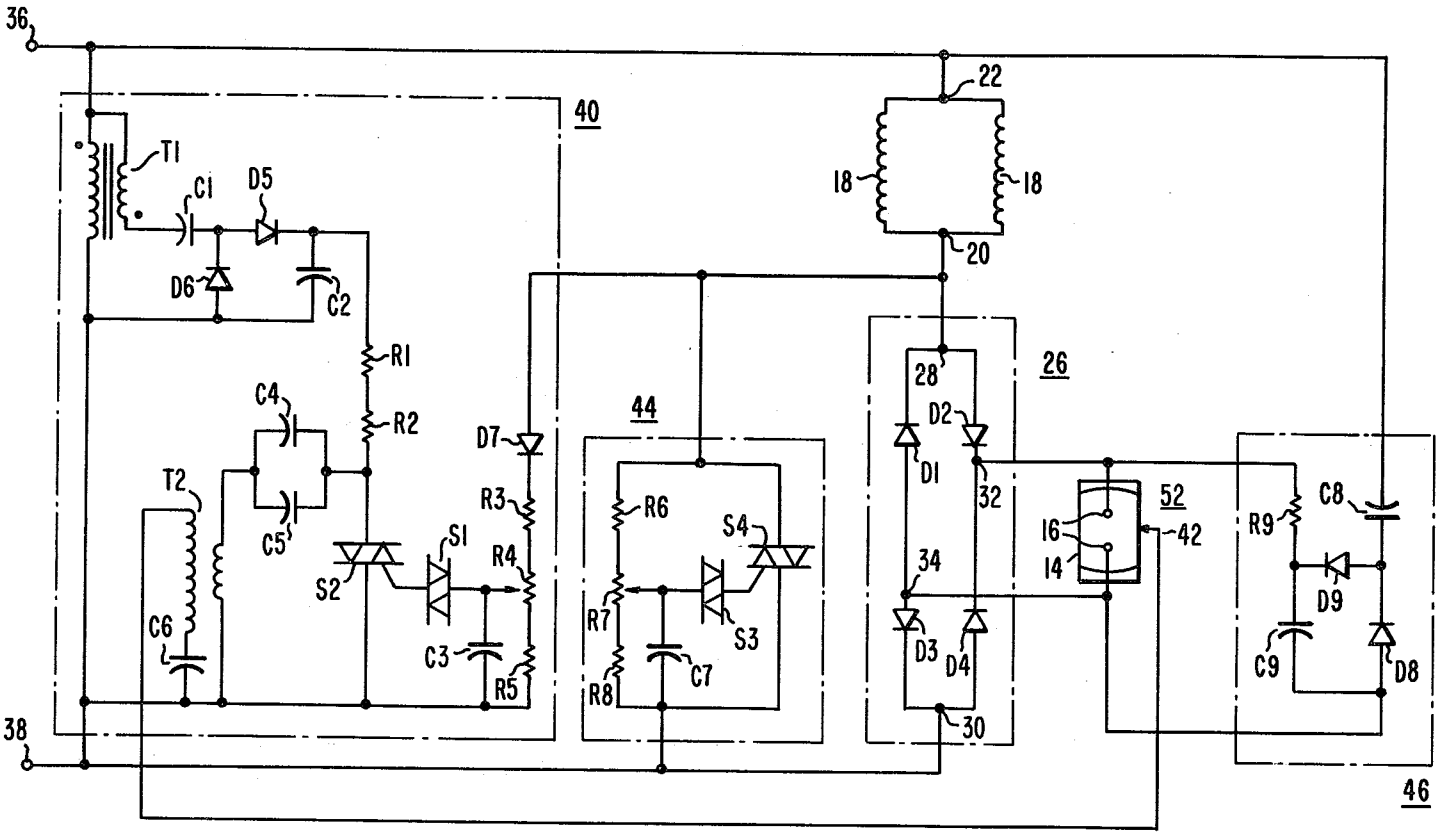
FIG. 2 is a circuit diagram which includes the lamp and ballast filament for the embodiment generally as shown in FIG. 1.

The specific circuit as shown in detail in FIG. 2 is designed to operate a 50 watt high pressure sodium arc discharge tube 52. The incandescent ballast filaments 18 are connected in parallel and each are rated at 150 watts, 120 V AC, although different filament wattages could be substituted therefor to vary the light available from the unitary light source. The circuit input terminals 36, 38 are adapted to be connected across the household-type source of AC energizing potential and the lamp 52 is as previously described with respect to the arc enclosing envelope 14 and electrodes 16. As described, the incandescent filament means 18 has two end portions 20 and 22.

The full-wave bridge rectifier means 26 comprises the diode bridge D1–D4 having two input terminals 28, 30 and two output terminals 32, 34. One end portion 20 of the filament ballast 18 connects to one input terminal 28 of the diode bridge 26 and the other end portion 22 of the filament ballast 18 connects to the input terminal 36 of the composite light source. The other input terminal 30 of the full-wave bridge 26 connects to the other input terminal 38 of the composite light source.

A high-voltage lamp-starting pulse-generating means 40 is operable from the AC energizing potential and has an output terminal constituting a high-voltage electrode 42 terminating proximate the envelope 14 of the discharge device 52 in order to ionize the atmosphere therein through a field-effect mechanism. In this embodiment, a voltage boosting arrangement comprising transformer T1, capacitors C1, C2, diodes D5, D6 and dropping resistors R1, R2 are used to boost the voltage available for the pulse generator 40. The pulse generator 40 is actuated through diode D7 and voltage divider formed of resistors R3–R5 to charge capacitor C3. When the capacitor C3 charges to 40 volts, the diac S1 conducts, triggering the thyristor S2 which discharges the capacitors C4 and C5 causing pulse transformer T2 to generate a pulse of approximately 4,000 volts which is applied to the field-effect electrode 42 to ionize the atmosphere within the arc tube envelope 14. The foregoing pulse generator will be triggered when a voltage of approximately 120 volts peak at the terminal 20 is sensed.

The low impedance path means 44 essentially connects in parallel with the pulse generator and comprises a voltage divider formed of R6–R8, diac S3 and triac S4, along with capacitor C7. When the capacitor charges to a predetermined value, the diac S3 conducts, triggering the thyristor S4, which essentially places a short circuit across the input terminals 28, 30 of the full-wave rectifier 26. In the operation of the pulse generator 40 and low impedance path means 44 as shown in the embodiment of FIG. 2, the pulse generator is adapted to be actuated just prior to the low impedance path means. As a specific example, a typical setting of the device will cause the pulse generator to be actuated when the voltage sensed is 120 volts peak with the low impedance path means being actuated when the voltage sensed is 130 volts peak. If the arc is initiated within the discharge device 52, the voltage across the input terminals 28, 30 of the full wave rectifier 26 will not rise to a value sufficient to energize the low-impedance path means 44. Once the low impedance path means is actuated, this in effect will provide a short circuit across the input terminals 28, 30 of the full-wave rectifier 26 and the ballast filaments 18 will be energized to full incandescence for the remainder of the half cycle.

As noted hereinbefore, devices which utilize a large capacitor in parallel with the output terminals of the full-wave rectifier 26 will inherently have a relatively poor power factor because of the current inrush to the capacitor. The present design dispenses with such a capacitor and it is necessary to provide a current source in order to maintain the operation of the lamp 14 during periods of conduction minima of the full-wave rectifier 26. This is achieved by providing capacitors C8, C9 and diodes D8, D9 connected in voltage doubling arrangement in circuit with the device input terminals 36, 38, with the output thereof being connected through a current limiting resistor R9 to the more positive output terminal 32 of the full-wave rectifier 26.

Summarizing the operation of the foregoing embodiment as shown in FIG. 1, the device as first turned on can be selected to provide one of two levels of brightness if desired, depending upon which ballasting filament is placed in circuit. During the first half cycle of operation, the pulse generator applies the high voltage pulse to the field-effect starting electrode 42 on the outside of the discharge tube envelope 14, with the major power flow being via the full-wave rectifier bridge 26 thereafter. During non-conducting intervals of the rectifier bridge, the lamp current is maintained at a minimum sustaining value from the keep-alive circuit 46. If power is interrupted momentarily after the lamp has reached its operating temperature, light will be provided entirely by the ballast filament means 18 which will then be connected directly across the power line via the action of the voltage-sensitive low-impedance means 44. Since the low-impedance means 44 and the pulse generator act in concert each half cycle of energizing potential, the electronics will repeatedly attempt to restart the hot discharge lamp. As the lamp cools and then restarts, the pulse generator and low impedance path means are automatically deactivated. Once the discharge within the lamp 52 is initiated, it in effect is placed in series with the ballast filament means 18. The ballast filament 18 will initially incandesce brightly because of the low voltage developed across the discharge lamp 52. As the lamp warms up and the voltage drop thereacross increases, the ballast filament 18 will become dimmer and the dimmer as the light output from the discharge lamp increases.

Following is a component chart for the circuit diagram as shown in FIG. 2. It should be noted that this circuit is designed to operate a 50 watt high pressure sodium lamp and to operate a smaller wattage lamp, the components would be scaled down considerably.

COMPONENT CHART

| Item | Identification |
|---|---|
| D1–D4, D8, D9 | IN5408 |
| D5, D6, D7 | IN5399 |
| C1 | 4μF–250V |
| C2 | 4μF–450V |
| C3–C7 | 0.01μF |
| C8, C9 | 40μF–450V |
| R1, R2 | 51 KΩ |
| R3, R6, R8 | 12 KΩ |
| R4, R7 | 50 KΩ pot |
| R9 | 5 KΩ, 12W |
| T1 | 120:30 |
| T2 | 4KV Trigger Coil Radio Shack 272–1146 |
| S1, S3 | 40V DIAC |
| S2, S4 | T2800D |

Figure 3:
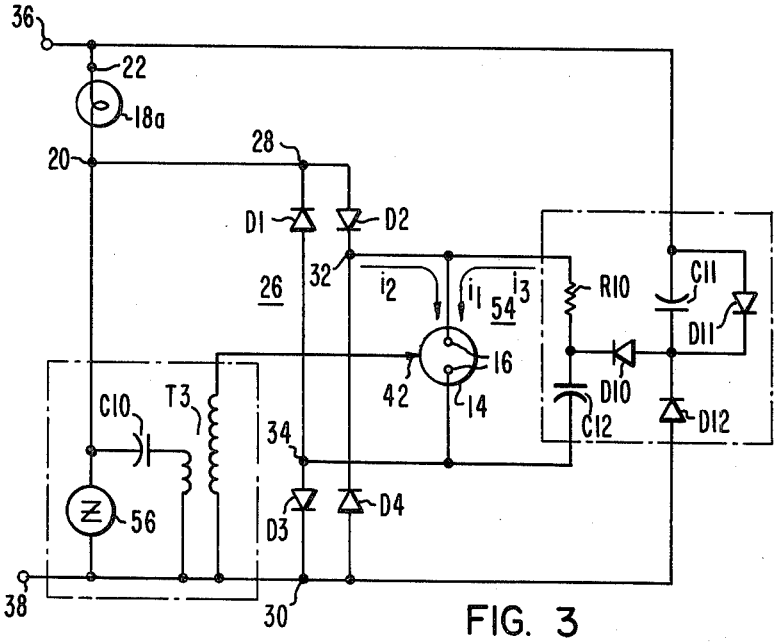
FIG. 3 is an alternative and simplified circuit diagram wherein the low impedance path means and pulse generator are consolidated into one unit.

In FIG. 3 is shown a circuit diagram of a greatly simplified arrangement wherein the pulse generator and low impedance path means are combined into one unit by means of a silicon bilateral voltage triggered switch. Upon application of a voltage exceeding the switch breakover point, the voltage sensitive switch turns on through a negative resistance region to a low on-state voltage. Conduction then continues until current is interrupted or drops below the required device holding current level. Thus in this application, once each half cycle, the switch will conduct at a predetermined voltage and conduction will continue until the current passes through a minimum value. Such a switch is sold under the trademark SIDAC by Teccor Electronics, Inc., Dallas, Tex.

The circuit as shown in FIG. 3 comprises the apparatus input terminals 36, 38 which are adapted to be connected to a household-type source of AC energizing potential, the HID lamp 54 which comprises the arc-enclosing envelope 14 having electrodes 16 sealed therethrough and operable to sustain a high-intensity-discharge therebetween. The incandescent ballast filament 18 a has two end portions 20 and 22. The full-wave rectifier means 26 has two input terminals 28, 30 and two output terminals 32, 34. One end portion 20 of the filament ballast 18*a* connects to one input terminal 28 of the full-wave rectifier 26 and the other end portion 22 of the filament ballast and the other input terminal 30 of the full-wave rectifier connect across the light source input terminals 36, 38.

The low impedance path means as previously described is a "SIDAC" switch 56 and it is selected to conduct when the potential developed thereacross is 120 to 130 volts. The pulse generator is combined with the switch 56 and comprises the pulse transformer T3 and a capacitor C10. When the SIDAC switch conducts, the capacitor C10 is discharged, generating a high voltage pulse each half cycle of energizing potential, which high voltage pulse is applied to the field-effect electrode 42. Whether the lamp starts or not, for the remainder of the half cycle the closed switch 56 will provide a very low impedance path which will cause the incandescent filament 18 to incandesce for the remainder of the half cycle when the switch again opens. To provide starting for the lamp, capacitors C11 and C12 with diodes D10, D11 and D12 are arranged in a voltage doubler arrangement with the output of the circuit connected to the more positive output terminal of the full-wave rectifier bridge 26 through a current limiting impedance R10.

To review the circuit operation, consider a nominal power line voltage (117 V rms, 165 V peak) a fully charged (330 V DC) starting-aid and keep-alive current source output capacitor (C12), a cold discharge lamp (54) and the SIDAC 56 with a nominal breakover voltage of 130 volts. As the power line sinusoidal increases, capacitor C10 charges to be substantially equal in voltage to the power line voltage. When the line voltage exceeds 130 V (about 52° electrical), the switch 56 suddenly conducts heavily, with its terminal voltage dropping to about one volt, and remains in that state until the next current zero of the power line (128° electrical later). In so "shorting", the switch 56 does two things: (1) it connects the incandescent ballast filament directly across the power line for the beginning of "instant light"; (2) it causes capacitor C10 to discharge its energy into the high voltage pulse transformer T3 with the ionization produced inside the discharge lamp being sufficient to cause current indicated as $i_1$ to flow through the lamp from the auxiliary current source. Lamp current cannot yet flow from the full-wave rectifier bridge 26 because the bridge is still "shorted" by the closed switch 56. By suitably choosing the components in the auxiliary current source, the discharge tube will remain in conduction through the next power line minimum. At that minimum point, the switch 56 recovers, and the rectified power line current ($i_2$) goes through the now-conducting discharge device during the next half cycle. After this lamp starting event, the role of the auxiliary current source is the same as for the embodiment of FIG. 2, namely, to supply "keep-alive" current ($i_3$) to the discharge tube during power line minima. With the discharge lamp operating, the starter/low resistance path becomes quiescent because the voltage at the "discharge tube input" line does not rise high enough to cause the SIDAC switch to breakover and conduct.

A more realistic situation for lamp starting corresponds to the capacitors C11 and C12 as shown in FIG. 3 being initially in a discharged state. The act of applying power to the combination light source will actually initiate two simultaneous events: (1) a train of starting pulses and bursts of ballast filament current will occur every half cycle of the energizing source, and (2) there will be a build-up of charge on the capacitors C11 and C12 which will require perhaps 10 power line cycles for full charging. During this time light comes only from the incandescent ballast filament 18 if the discharge lamp 54 is not in a condition to be started by the applied DC voltage. If the discharge lamp is started, both the lamp and the incandescent ballast filament will provide light.

As a possible alternative embodiment, the resistor R10 which provides a current limiting impedance for the auxiliary current source may take the form of a second incandescent filament to supplement the overall light output, if desired.

In the embodiment as shown, the charging path for capacitor C12 is via C11, C10 and D3. The diode D11 prevents reverse voltages on C11 if the user first applies the power when the input terminal 36 is positive with respect to the input terminal 38. The charging path for capacitor C11 is via diode D12.

As a possible alternative embodiment for the circuits of FIG. 2 or FIG. 3, the high-voltage electrode 42 could be connected to the lamp lead-in proximate the uppermost electrode 16 with a small additional capacitor connected between the electrode 42 and the transformer T3 to block the DC from the pulse transformer T3. A small high-frequency choke in the same lead-in conductor to which the electrode 42 connects would be used to block the high-voltage starting pulse from the D.C. source.

We claim:

1. A unitary light source for operation from a source of AC energizing potential, comprising an HID lamp, a light-emitting starting and operating circuit therefor, and input terminals for connection to a source of AC energizing potential; said light source providing illumination during the warm-up period required for said HID lamp and also after short periods of power interruption when said HID lamp is hot and thus difficult to start, said HID lamp comprising an arc-enclosing envelope having spaced electrodes sealed therethrough and operable to sustain a high intensity discharge therebetween; and said light emitting starting and operating circuit comprising:

an incandescent tungsten filament ballast device having two end portions;

a full-wave rectifier having two input terminals and two output terminals, one end portion of said filament ballast device being connected to one input terminal of said full-wave rectifier, the other end portion of said filament ballast device and the other input terminal of said full-wave rectifier being connected respectively to the unitary light source input terminals, and said HID lamp electrodes being connected respectively to the output terminals of said full-wave rectifier;

low impedance path means connected in parallel with said input terminals of said full-wave rectifier, for passing current through said ballast when said HID lamp is not operating, said means being actuated responsive to a predetermined potential developed across said input terminals of said full-wave rectifier during each half cycle of said AC energizing potential, which predetermined potential is greater than the maximum potential developed across said input terminals of said full-wave rectifier when said HID lamp is operating, to provide a path of low electrical impedance which parallels said input terminals of said full-wave rectifier, a pulse generating circuit connected in parallel with said input terminals of said full-wave rectifier, for providing a high starting voltage pulse for said HID lamp, said pulse generating circuit comprising an output terminal constituting a high-voltage electrode operatively associated with said HID lamp, arranged such that actuation of said low impedance path means, in response to a potential across said input terminals of said full-wave rectifier greater than said predetermined potential, triggers said pulse generating circuit to generate a high voltage pulse of magnitude sufficient to ionize the atmosphere within said arc-enclosing envelope of said HID lamp;

and an HID lamp keep-alive and starting-aid having an input connected across said light source input terminals and an output connected across said output terminals of said full-wave rectifier, said keep-alive and starting-aid comprising means for storing DC energy of the same polarity as the output of said full-wave rectifier upon initial energization of said light-source, said DC energy being of predetermined charge and magnitude sufficient to sustain a discharge in said HID lamp for a short period during starting thereof and during periods of conduction minima of said full wave rectifier.

2. A light source as claimed in claim 1, wherein said low impedance path means and pulse generating circuit comprise a two-terminal voltage-sensitive switch connected across said input terminals of said full-wave rectifier; a pulse transformer having a primary winding and a secondary winding; a capacitor connected in series with the primary winding of said pulse transformer, the series combination of capacitor and primary winding being connected across the terminals of said voltage-sensitive switch, and the secondary winding of said pulse transformer being connected to said high voltage electrode.

3. A light source as claimed in claim 1, wherein said HID lamp keep-alive and starting-aid comprises a voltage doubler circuit connected across said light source input terminals, and a current limiting impedance, said current limiting impedance being connected between the more positive output terminal of said voltage doubler and the more positive output terminal of said full-wave rectifier.

4. A unitary light source for operation from a source of AC energizing potential, comprising an HID lamp, a light-emitting starting and operating circuit therefor, and input terminals for connection to a source of AC energizing potential; said light source providing illumination during the warm-up period required for said HID lamp and also after short periods of power interruption when said HID lamp is hot and thus difficult to start, said HID lamp comprising an arc-enclosing envelope having spaced electrodes sealed therethrough and operable to sustain a high intensity discharge therebetween; and said light emitting starting and operating circuit comprising:

an incandescent tungsten filament ballast device having two end portions;

a full-wave rectifier having two input terminals and two output terminals, one end portion of said filament ballast device being connected to one input terminal of said full-wave rectifier, the other end portion of said filament ballast device and the other input terminal of said full-wave rectifier being connected to the respective unitary light source input terminals, and said HID lamp electrodes being connected to respective output terminals of said full-wave rectifier;

low impedance path means connected in parallel with said input terminals of said full-wave rectifier, for passing current through said ballast when said HID lamp is not operating, said means being responsive to a predetermined potential developed across said input terminals of said full-wave rectifier during each half cycle of said AC energizing potential, which predetermined potential is greater than the maximum potential developed across said input terminals of said full-wave rectifier when said HID lamp is operating, to provide a path of low electrical impedance which parallels said input terminals of said full-wave rectifier, a pulse generating circuit operable from said light source input terminals, for providing a high starting voltage pulse for said HID lamp, said pulse generating circuit comprising an output terminal constituting a high-voltage electrode terminating proximate said HID lamp; means, responsive to application of said AC energizing potential across said light source input terminals when said HID lamp is not operating, for generating high voltage pulses of magnitude sufficient to ionize the atmosphere within said arc-enclosing envelope of said HID lamp; and means for rendering said pulse generating means inoperative responsive to an HID lamp-operating parameter; and an HID lamp keep-alive means having an output connected across said output terminals of said full-wave rectifier, for suppling operating energy to said HID lamp to maintain operation of said HID lamp during periods of conduction minima of said full wave rectifier.

* * * * *